US006975275B2

(12) United States Patent
Choi

(10) Patent No.: US 6,975,275 B2
(45) Date of Patent: Dec. 13, 2005

(54) ELECTRIC WAVE TRANSMITTING AND RECEIVING APPARATUS OF PORTABLE TERMINAL

(75) Inventor: Tae-Kyu Choi, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/664,161

(22) Filed: Sep. 17, 2003

(65) Prior Publication Data

US 2004/0058724 A1 Mar. 25, 2004

(30) Foreign Application Priority Data

Sep. 19, 2002 (KR) ..... 10-2002-0057444

(51) Int. Cl.[7] ..... H01Q 1/24
(52) U.S. Cl. ..... 343/702; 343/882; 343/906
(58) Field of Search ..... 343/702, 878, 343/880, 882, 906; 455/90

(56) References Cited

U.S. PATENT DOCUMENTS 6,429,817 B1 * 8/2002 Creigh et al. ..... 343/702

* cited by examiner

*Primary Examiner*—Hoang V. Nguyen
(74) *Attorney, Agent, or Firm*—Fleshner & Kim, LLP

(57) ABSTRACT

An electric wave transmitting and receiving apparatus of a portable terminal comprising: a rotating member axially installed in a mounting groove formed at an upper portion of a body to be rotated with a certain angle; a vertical polarization antenna installed at an upper of the rotating member, for rotating the rotating member around the axis by a pressure of a folder at the time of opening the folder of the portable terminal; an elastic member installed at one side of the rotating member, for placing the rotated vertical polarization antenna and the rotating member to original positions; a vertical polarization antenna connecting means for connecting the vertical polarization antenna to a printing circuit board mounted in the body; a circular polarization antenna installed at a side surface of the rotating member; and a circular polarization antenna connecting means for connecting the circular polarization antenna to the printing circuit board.

39 Claims, 7 Drawing Sheets

ELECTRIC WAVE TRANSMITTING AND RECEIVING APPARATUS OF PORTABLE TERMINAL

BACKGROUND OF THE INVENTION

1. Field of the Invention

The present invention generally relates to wireless communications, and more particularly to an electric wave transmitting and receiving apparatus of a wireless terminal.

2. Background of the Related Art

An antenna used in a portable terminal (e.g., a cellular phone) includes a vertical polarization antenna installed at an outer side of the terminal body and a circular polarization antenna mounted at a printing circuit board. These antenna are used for transmitting and receiving audio and data.

In a cellular phone, a signal amplified by a high frequency circuit therein is converted into electromagnetic waves through an antenna, which may badly influence a user's brain adjacent the antenna. As the number of cellular phone users increase, arguments in support of the theory that these waves are harmful to the human body increase.

FIG. 1 is a lateral view showing a portable terminal in accordance with the related art, and FIG. 2 is a lateral view showing a vertical polarization antenna of a portable terminal in accordance with the related art. The related-art portable terminal comprises: a body 10; a folder 20 hinge-coupled at an upper portion of the body 10 for opening and closing; a chargeable battery 30 attachably and detachably coupled at a rear surface of the body 10; and an antenna 40 coupled at an upper surface of the body 10 for transmitting and receiving an electric wave. The antenna 40, as shown in FIG. 2, includes an antenna line 42 of a coil shape installed within a radome 41, and a fixed screw 43 installed at a lower portion of the antenna line 42 to be electrically connected. By screw-engaging the fixed screw 43 of the antenna 40 to the body 10, the antenna is electrically connected to a printing circuit board (not shown). Also, a circular polarization antenna (not shown) is mounted at one side of the printing circuit board.

In the related-art portable terminal, the vertical polarization antenna is located adjacent to the user's head during a call and is fixed in a constant direction. It is therefore difficult to control a position or a direction of the vertical polarization antenna and thus to prevent an electromagnetic wave from harming the user.

Also, the circular polarization antenna is mounted in the body, that is, in the printing circuit board. In this position, sensitivity for transmitting and receiving calls is lowered.

SUMMARY OF THE INVENTION

An object of the present invention is to solve one or more problems of the related-art terminal described above.

Another object of the present invention is to provide a wireless terminal which includes an electric wave transmitting and receiving apparatus that minimizes the harmful influence of electromagnetic waves on a user's body by making an antenna of the terminal rotate at a certain angle when a folder of the terminal is opened for calling.

Another object of the present invention is to provide a wireless terminal which includes an electric wave transmitting and receiving apparatus that increases a receiving sensitivity by exposing not only a vertical polarization antenna but also a circular polarization antenna to the outside of a body.

To achieve these and other objects and advantages, the present invention provides an electric wave transmitting and receiving apparatus of a portable terminal comprising: a rotating member axially installed in a mounting groove formed at an upper portion of a body to be rotated with a certain angle; a vertical polarization antenna installed at an upper of the rotating member, for rotating the rotating member around the axis by a pressure of a folder at the time of opening the folder of the portable terminal; an elastic member installed at one side of the rotating member, for placing the rotated vertical polarization antenna and the rotating member to original positions; a vertical polarization antenna connector for connecting the vertical polarization antenna to a printing circuit board mounted in the body; a circular polarization antenna installed at a side surface of the rotating member; and a circular polarization antenna connector for connecting the circular polarization antenna to the printing circuit board.

The vertical polarization antenna connector includes: a vertical polarization antenna feeder line installed at an outer circumference surface of the rotating member in a contacted state with the vertical polarization antenna, and a vertical polarization antenna feeder line elastic supporting portion elastically installed at one side of the printing circuit board in a contacted state with the vertical polarization antenna feeder line.

The circular polarization antenna connector includes: a circular polarization antenna feeder line extendedly installed at an outer circumference surface of the rotating member in a contacted state with the circular polarization antenna, and a circular polarization antenna feeder line elastic supporting portion elastically installed at one side of the printing circuit board in a contacted state with the circular polarization antenna. The circular polarization antenna feeder line penetrates an axial hole formed at a center of the rotating member, and is installed at an outer circumference surface of the rotating member in a longitudinal direction.

DETAILED DESCRIPTION OF PREFERRED EMBODIMENTS

Figure 1:
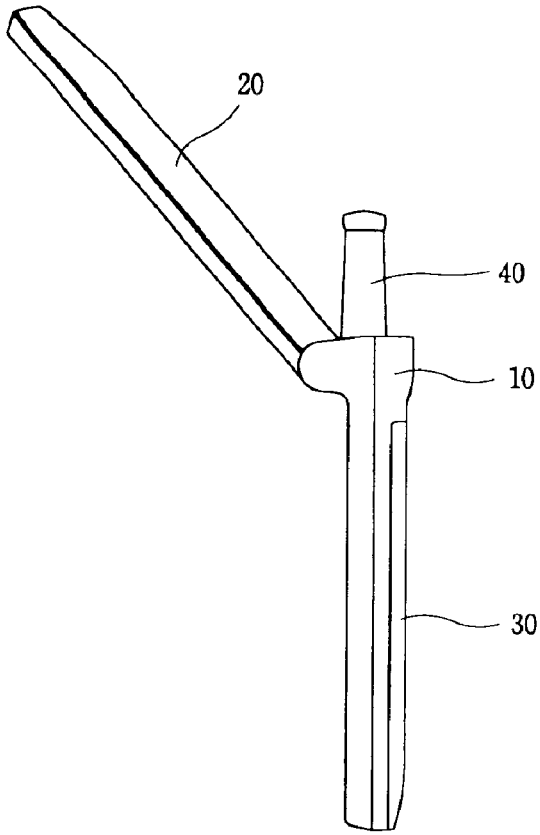
FIG. 1 RELATED ART
FIG. 1 is a lateral view showing a portable terminal in accordance with the related art.
Figure 2:
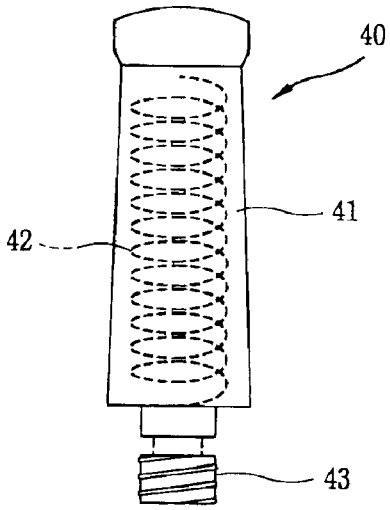
FIG. 2 RELATED ART
FIG. 2 is a lateral view showing an antenna of a portable terminal in accordance with the related art.
Figure 3:
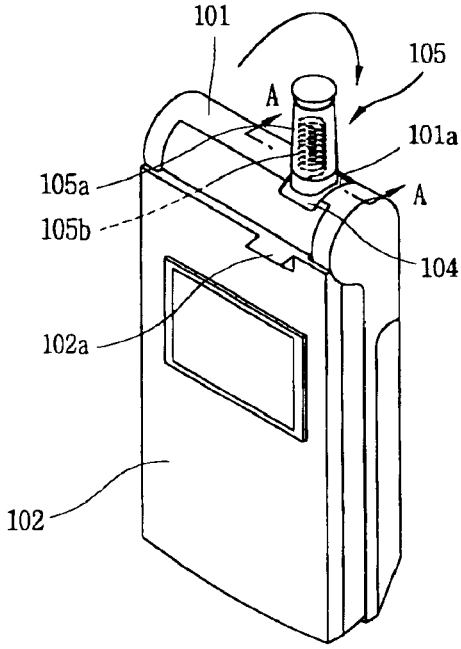
FIG. 3 is a perspective view showing an electric wave transmitting and receiving apparatus of a portable terminal according to the present invention.
Figure 4:
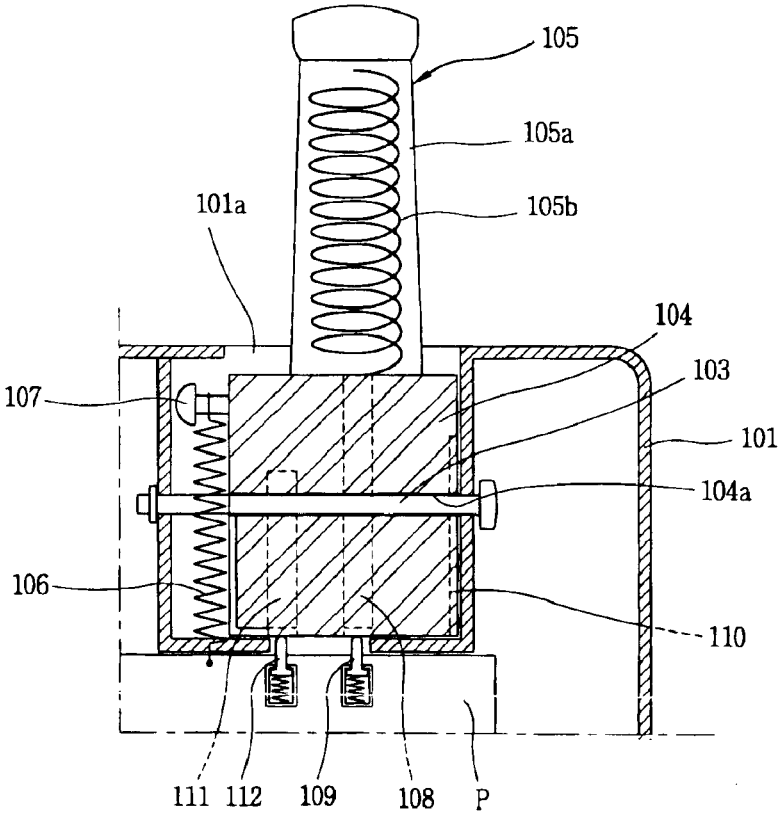
FIG. 4 is a sectional view taken along line A—A of FIG. 3.

Referring to FIGS. 3 and 4, a portable terminal in accordance with one embodiment of the present invention includes a folder 102 hinge-coupled at an upper portion of a body 101 for opening and closing. A mounting groove 101*a* is formed at the upper portion of the body at a part where the body and the folder are hinge-coupled. An upper portion of the mounting groove 101*a* is opened, and a lower portion thereof is connected to a printing circuit board P inside the body.

An insulation axis 103 is installed in the mounting groove 101 in a horizontal direction, and a rotating member 104 is installed on the axis 103 with a horizontal cylindrical shape. More specifically, a circular polarization feeder line 111 which will be later explained is installed at an inner circumferential surface of an axial hole 104*a* formed at a center of the rotating member 104, and the axis 103 is inserted into the axial hole 104*a*. The axis is preferably formed of an insulating material only, in order to rotate the rotating member 104. In this arrangement, the rotating member 104 rotates around axis 103.

A vertical polarization antenna 105 is fixed at an upper surface of the rotating member 104. When a user opens folder 102 of the portable terminal for calling, the vertical polarization antenna 105 is pressed in a backward direction by the folder 102. The force provided by the folder causes the rotating member 104 to rotate a certain angle pointing away from the user's head. In order to make the vertical polarization antenna 105 smoothly rotate as folder 102 presses the vertical polarization antenna 105 backwards, a push protrusion 102*a* is preferably extendedly formed at one side of an upper portion of the folder 102 in alignment with antenna 105.

A tension spring 106 is also preferably included for placing the vertical polarization antenna 105 and the rotating member 104 back to their original positions when the user closes the folder 102 after calling is terminated. As shown, the tension spring may be installed adjacent a side surface of the rotating member 104. One end of the tension spring 106 is fixed on a stopping protrusion 107 formed at the side surface of the rotating member 104, and the other end of the spring is fixed on a bottom surface of the mounting groove 101*a*, that is, one side of the body 101.

Figure 5:
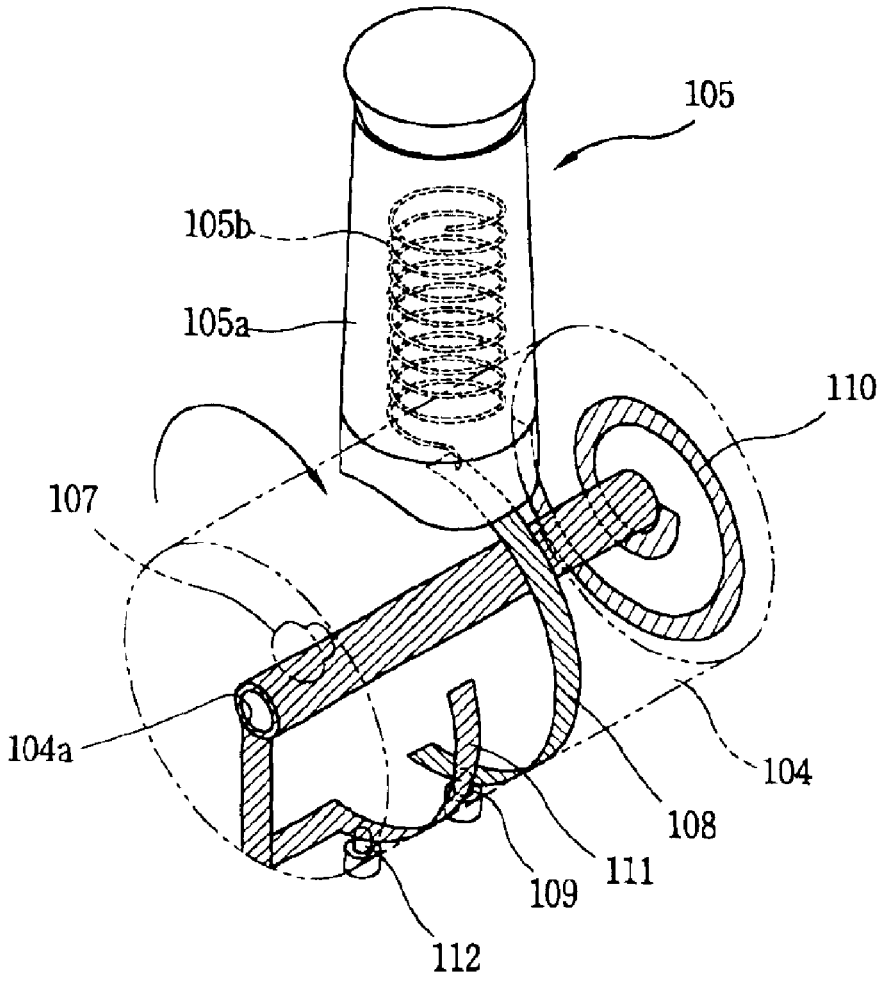
FIG. 5 is a perspective view of an extracted main part for explaining a vertical polarization antenna feeder line and a circular polarization antenna feeder line of FIG. 3.

Referring to FIG. 5, a helical antenna line 105*b* of a coil form is installed within a radome 105*a* of the vertical polarization antenna 105. A lower portion of the helical antenna line 105*b* is connected to the vertical polarization antenna feeder line 108 formed along an outer circumferential surface of the rotating member 104 in a longitudinal direction.

A vertical polarization antenna feeder line elastic supporting portion 109 elastically mounted at the printing circuit board P is preferably always in contact with a lower portion of the vertical polarization antenna feeder line 108. Even though the rotating member 104 is rotated around the axis 103, the vertical polarization antenna feeder line elastic supporting portion 109 maintains an elastic contact state with the vertical polarization antenna feeder line 108.

A circular polarization antenna 110 for transmitting and receiving circularly polarized signals is installed at one side of the rotating member 104. The circular polarization antenna 110 is connected to the circular polarization antenna feeder line elastic supporting portion 112 elastically installed at the printing circuit board P by the circular polarization antenna feeder line 111. A structure of the circular polarization antenna feeder line 111 will be explained as follows.

First, the circular polarization antenna feeder line 111 is inserted into axial hole 104*a* at one side of rotating member 104 while being connected to the circular polarization antenna 110, formed at side surface of the rotating member 104, and installed at an inner circumference surface. Then, the circular polarization antenna feeder line 111 is carried out to the axial hole 104*a* of the other side of the rotating member, and then extended to a side surface, a lower surface, and an outer circumference surface of the rotating member 104. At this time, the circular polarization antenna feeder line 111 is installed at an outer circumference surface of the rotating member 104 in a parallel state to the vertical polarization antenna feeder line 108.

The vertical polarization antenna 105 transmits and receives an electric wave to the printing circuit board P through the helical antenna line 105*b*, the vertical polarization antenna feeder line 108, and the vertical polarization antenna feeder line elastic supporting portion 109. Also, the circular polarization antenna 110 transmits and receives an electric wave to and from the printing circuit board P through the circular polarization antenna 110, the circular polarization antenna feeder line 111, and the circular polarization antenna feeder line elastic supporting portion 112.

Operation effects of the transmitting and receiving apparatus of the portable terminal according to the present invention are as follows.

Figure 6A:
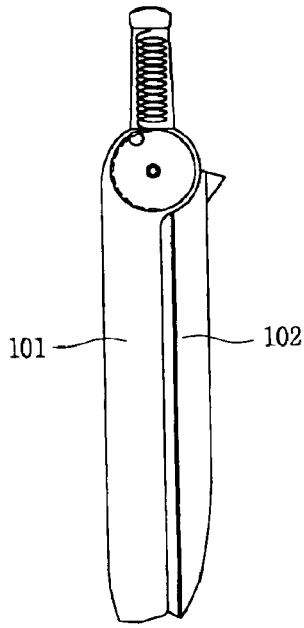
FIG. 6A shows a side view of the terminal of the present invention in a closed-folder state.
Figure 6B:
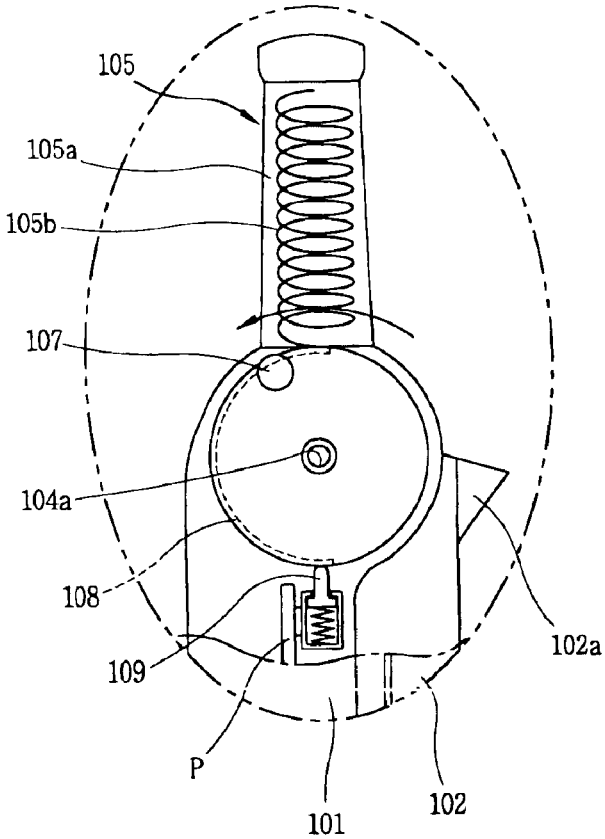
FIG. 6B is an exploded view showing a contact state of a vertical polarization antenna feeder line and its elastic supporting portion in the closed-folder state in accordance with the present invention.

As shown in FIGS. 6A and 6B, in an initial state, the vertical polarization antenna 105 is vertically positioned when the folder is closed. The vertical polarization antenna feeder line elastic supporting portion 109 is elastically (e.g., spring-biased) in contact with the vertical polarization antenna feeder line 108. Arranged in this manner, an electromagnetic wave generated from the vertical polarization antenna 105 is transmitted to the printing circuit board P through the vertical polarization antenna feeder line 108 and the vertical polarization antenna feeder line elastic supporting portion 109.

Figure 7A:
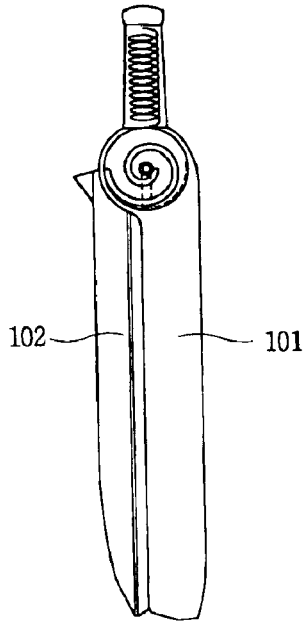
FIG. 7A shows a side view of a terminal of the present invention in a closed-folder state.
Figure 7B:
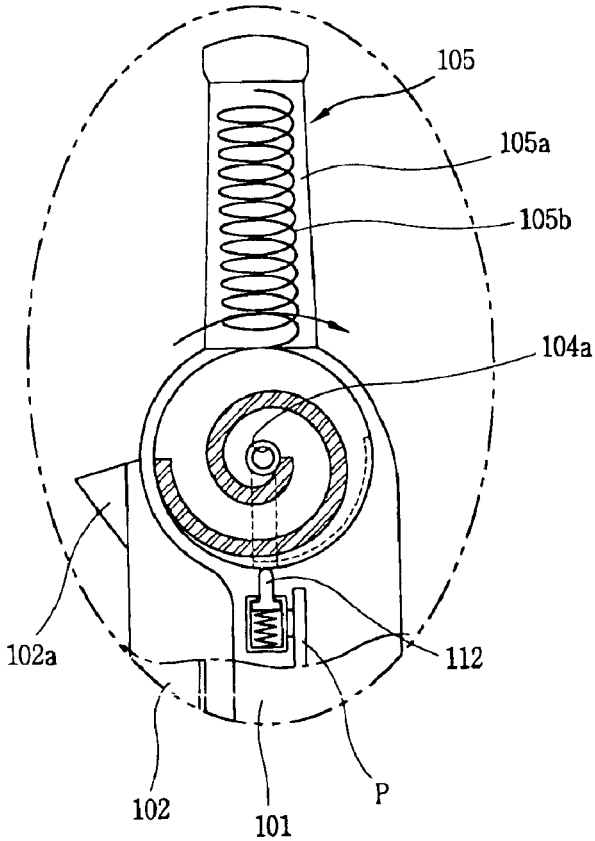
FIG. 7B is an exploded view showing a contact state of a circular polarization antenna feeder line and its elastic supporting portion in the closed-folder state in accordance with the present invention.

As shown in FIGS 7A and 7B, the circular polarization antenna 110 is installed at a side surface of the rotating member 104 and the circular polarization antenna feeder line elastic supporting portion 112 is elastically in contact with the circular polarization antenna feeder line 111. Arranged in this manner, an electromagnetic wave generated from the circular polarization antenna 110 is transmitted to the printing circuit board P through the circular polarization antenna feeder line 111 and the circular polarization antenna feeder line elastic supporting portion 112.

Figure 8A:
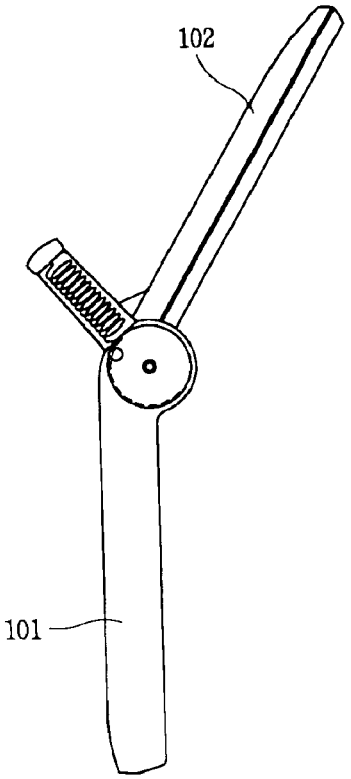
FIG. 8A shows a side view of the terminal of the present invention in an open-folder state.
Figure 8B:
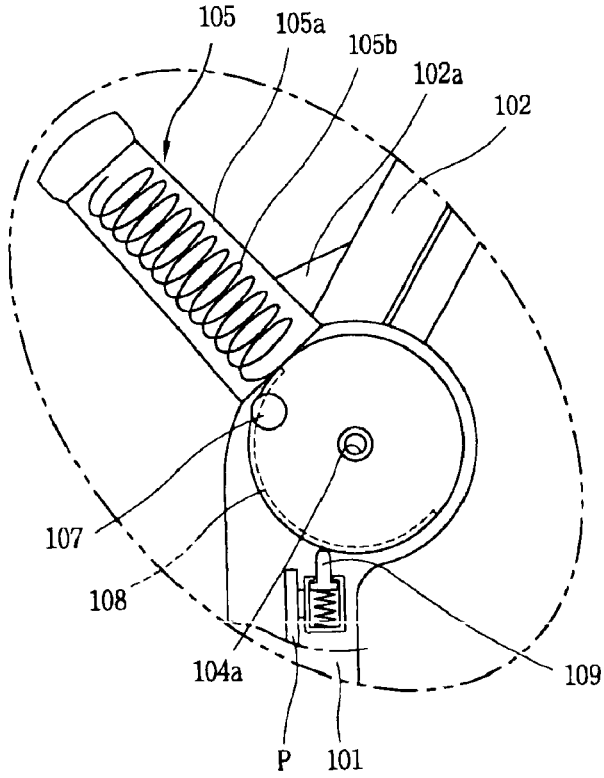
FIG. 8B is an exploded view showing a contact state of a vertical polarization antenna feeder line and its elastic supporting portion in the open-folder state in accordance with the present invention.

As shown in FIGS. 8A and 8B, when user opens folder 102 of the terminal for calling, the vertical polarization antenna 105 is pressed back by push protrusion 102*a* of the opened folder 102. At this time, the rotating member 104 to which the vertical polarization antenna 105 is fixed is rotated around axis 103 to a certain angle in a backwards direction and away from the user's head.

Figure 9A:
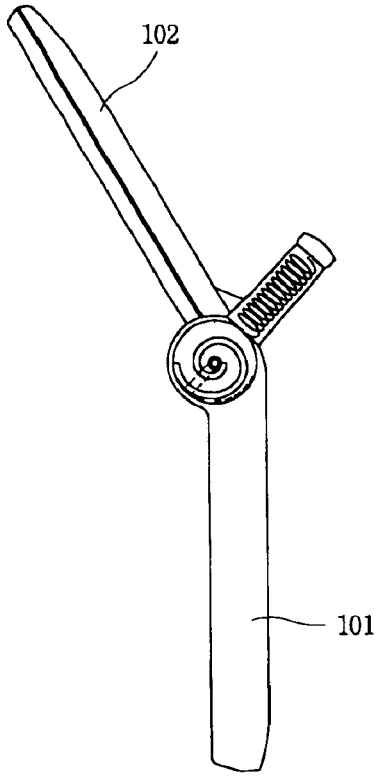
FIG. 9A is another side view of the terminal of the present invention in an open-folder state.
Figure 9B:
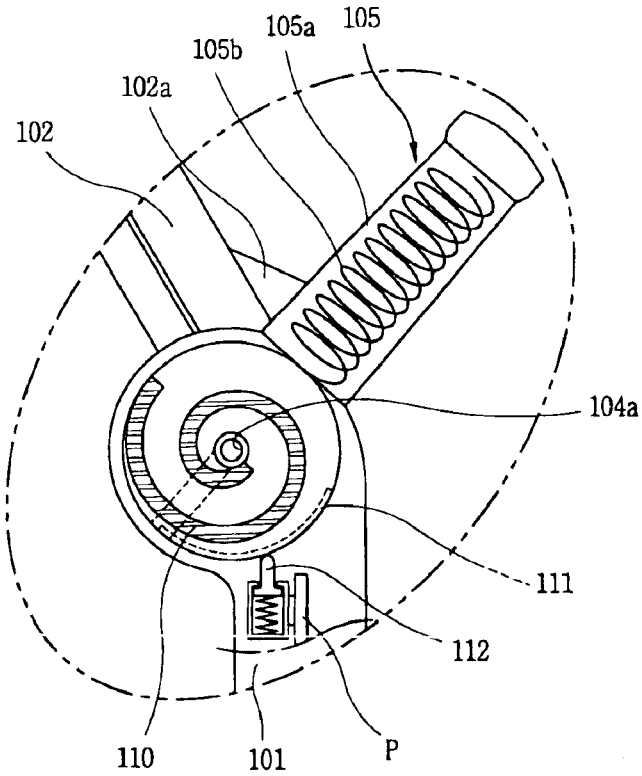
FIG. 9B is an exploded view showing a contact state of a circular polarization antenna feeder line and its elastic supporting portion in the open-folder state in accordance with the present invention.

As shown in FIGS. 9A and 9B, the vertical polarization antenna feeder line elastic supporting portion 109 and the circular polarization antenna feeder line elastic supporting portion 112 are respectively in contact with the vertical polarization antenna feeder line 108 and the circular polarization antenna feeder line 111. As a result, an electromagnetic wave generated from the vertical polarization antenna 105 is transmitted to the printing circuit board P through the vertical polarization antenna feeder line 108 and the vertical polarization antenna feeder line elastic supporting portion 109. Also, an electromagnetic wave generated from the circular polarization antenna 110 is transmitted to the printing circuit board P through the circular polarization antenna feeder line 111 and the circular polarization antenna feeder line elastic supporting portion 112. Therefore, transmission and reception of signals can be smoothly performed while the antenna 105 is in its retracted position.

More specifically, in this position the vertical polarization antenna 105 is apart from the user's head and maintains a certain angle at the time of calling, thereby minimizing harm to the user due to electromagnetic waves generated at the time of the calling. Also, the circular polarization antenna 110 is preferably exposed to an outside portion of the body 101, thus enhancing transmission and reception sensitivity.

In summary, the vertical polarization antenna 105 is constructed to be rotated in a backwards direction to a certain angle when folder 102 is opened for calling. In this position, the vertical polarization antenna 105 is apart from the user's head and maintains a certain angle at the time of calling, thus minimizing harm to the user from electromagnetic waves generated at the time of the calling. Also, the circular polarization antenna 110 is constructed to be exposed to outside of the body 101, to enhance transmission and reception sensitivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electric wave transmitting and receiving apparatus for a wireless terminal, comprising:

a support member rotatably supported in the terminal;

a vertical polarization antenna connected to the support member;

a bias member which returns the support member to an original position from a rotated position; and a connector which electronically connects the vertical polarization antenna to a printed circuit board mounted in the terminal.

2. The apparatus of claim 1, wherein the connector comprises:

a feeder line at least partially located on the support member and in contact with the vertical polarization antenna; and an elastic supporting portion coupled to the printed circuit board and in contact with the feeder line.

3. The apparatus of claim 1, further comprising:

a circular polarization antenna connected to the support member; and a connector which electronically connects the printed circuit board to the circular polarization antenna.

4. The apparatus of claim 3, wherein the connector comprises:

a feeder line at least partially located on the support member and in contact with the circular polarization antenna; and an elastic supporting portion coupled to the printed circuit board and in contact with the circular polarization antenna.

5. The apparatus of claim 1, wherein the support member has a cylindrical shape.

6. The apparatus of claim 1, wherein one end of the bias member is fixed to a stopping protrusion on the support member and another end of the bias member is coupled to a body of the terminal.

7. The apparatus of claim 1, wherein the bias member is a spring.

8. An electric wave transmitting and receiving apparatus for a wireless terminal, comprising:

a support member rotatably supported in the terminal;

a vertical polarization antenna connected to the support member;

a bias member which returns the support member to an original position from a rotated position;

a first connector which connects the vertical polarization antenna to a printed circuit board of the terminal;

a circular polarization antenna connected to the support member; and a second connector which connects the circular polarization antenna to the printed circuit board.

9. The apparatus of claim 8, wherein the first connector comprises:

a feeder line at least partially located on the support member and in contact with the vertical polarization antenna; and an elastic supporting portion coupled to the printed circuit board and in contact with the feeder line.

10. The apparatus of claim 8, wherein the second connector comprises:

a feeder line at least partially located on the support member and in contact with the circular polarization antenna; and an elastic supporting portion coupled to the printed circuit board and in contact with the circular polarization antenna.

11. The apparatus of claim 10, wherein the feeder line is located in an axial hole at a center of the support member and continues along a circumferential surface of the support member.

12. A wireless terminal, comprising:

a body;

a covet rotatably connected to the body; and a support member rotatably mounted within the body and supporting an antenna, wherein the support member rotates from a first position to a second position when the cover is opened relative to the body.

13. The terminal of claim 12, wherein the antenna rotates with the support member as a result of being supported by the antenna.

14. The terminal of claim 13, wherein the support member rotates as a result of a portion of the cover pressing against the support member when the cover is opened relative to the body.

15. The terminal of claim 13, wherein the portion of the cover which presses against the support member is a protruding member extending from the cover.

16. The terminal of claim 13, further comprising:

a bias member which returns the support member to the first position when the cover is closed relative to the body.

17. A wireless terminal comprising:

a body;

a cover rotatably connected to the body;

a support member rotatably mounted within the body and supporting an antenna; and an electrical contact on the support member, wherein one end of the contact is coupled to the antenna and a second end is coupled to a circuit of the terminal.

18. The terminal of claim 17, further comprising:

wherein the contact is at least partially formed on an outer surface of the support member.

19. The terminal of claim 18, wherein the support member has a substantially cylindrical shape and wherein the contact is at least partially formed along an outer circumferential surface of the support member.

20. The terminal of claim 18, wherein the support member has a substantially cylindrical shape and wherein the contact is at least partially formed along an axial surface of the support member.

21. The terminal of claim 18, further comprising:

a conductive member located between the circuit and electrical contact, wherein the electrical contact has a length sufficient to maintain an electrical connection between the conductive member and the contact during rotation of the support member.

22. The terminal of claim 21, wherein the conductive member is elastically biased.

23. A wireless terminal, comprising:

a body;

a first antenna;

a cover rotatably connected to the body; and a support member rotatably mounted within the body and supporting the first antenna, wherein the support member rotates from a first position to a second position when the cover is opened relative to the body.

24. The terminal of claim 23, wherein the first antenna rotates with the support member as a result of being supported by the first antenna.

25. The terminal of claim 24, wherein the support member rotates as a result of a portion of the cover pressing against the support member when the cover is opened relative to the body.

26. The terminal of claim 24, wherein the portion of the cover which presses against the support member is a protruding member extending from the cover.

27. The terminal of claim 24, further comprising:

a bias member which returns the support member to the first position when the cover is closed relative to the body.

28. The terminal of claim 23, wherein the antenna is a vertical polarization antenna.

29. A wireless terminal comprising:

a body;

a first antenna;

a cover rotatably connected to the body;

a support member rotatably mounted within the body and supporting the first antenna; and an electrical contact on the support member, wherein one end of the contact is coupled to the first antenna and a second end is coupled to a circuit of the terminal.

30. The terminal of claim 29, further comprising:

wherein the contact is at least partially formed on an outer surface of the support member.

31. The terminal of claim 30, wherein the support member has a substantially cylindrical shape and wherein the contact is at least partially formed along an outer circumferential surface of the support member.

32. The terminal of claim 30, wherein the support member has a substantially cylindrical shape and wherein the first contact is at least partially formed along an axial surface of the support member.

33. The terminal of claim 30, further comprising:

a conductive member located between the circuit and electrical contact, wherein the electrical contact has a length sufficient to maintain an electrical connection between the conductive member and the contact during rotation of the support member.

34. The terminal of claim 33, wherein the conductive member is elastically biased.

35. A wireless terminal comprising:

a body;

a first antenna;

a cover rotatably connected to the body;

a support member rotatably mounted within the body and supporting the first antenna; and a second antenna on the support member, wherein the first antenna is a vertical polarization antenna and the second antenna is a circular polarization antenna.

36. The terminal of claim 35, further comprising:

a first electrical contact which electrically connects the vertical polarization antenna to a circuit of the terminal; and a second electrical contact which electrical connects the circuit to the circular polarization antenna.

37. The terminal of claim 36, wherein the first and second electrical contacts have lengths sufficient to maintain electrical connection between the vertical and circular polarization antennas and the circuit during rotation of the support member.

38. The terminal of claim 35, wherein the vertical polarization antenna is fixed to a first surface of the support member and the circular polarization antenna is fixed to a second surface of the antenna.

39. The terminal of claim 35, wherein the support member has a substantially cylindrical shape and wherein the vertical polarization antenna is connected to a circumferential surface of the support member and the circular polarization antenna is connected to an axial surface of the support member.

* * * * *

UNITED STATES PATENT AND TRADEMARK OFFICE

CERTIFICATE OF CORRECTION

PATENT NO. : 6,975,275 B2
DATED : December 13, 2005
INVENTOR(S) : Tae-Kyu Choi

It is certified that error appears in the above-identified patent and that said Letters Patent is hereby corrected as shown below:

Column 6,
Line 53, delete “covet” and insert -- cover --.

Signed and Sealed this

Seventh Day of February, 2006

JON W. DUDAS
*Director of the United States Patent and Trademark Office*